United States Patent [19]

Saito et al.

[11] Patent Number: 4,713,633

[45] Date of Patent: Dec. 15, 1987

[54] COVER ATTACHING ARRANGEMENT FOR CASING OF DIELECTRIC COAXIAL RESONATORS

[75] Inventors: Koji Saito; Hiroshi Okawa, both of Kanazawa, Japan

[73] Assignee: Murata Manufacturing Co., Ltd., Nagokakyo, Japan

[21] Appl. No.: 943,391

[22] Filed: Dec. 19, 1986

[30] Foreign Application Priority Data

Dec. 24, 1985 [JP] Japan ..... 60-295736

[51] Int. Cl.[4] ..... H01P 1/205

[52] U.S. Cl. ..... 333/222; 333/206; 361/394; 361/424

[58] Field of Search ..... 333/206, 219, 222 X; 174/35 R, 51, 52 R; 361/331, 380, 392–394, 424

[56] References Cited

U.S. PATENT DOCUMENTS 4,494,095 1/1985 Noji ..... 174/35 R 4,567,454 1/1986 Saito ..... 333/206

*Primary Examiner*—G. P. Tolin

*Attorney, Agent, or Firm*—Armstrong, Nikaido, Marmelstein & Kubovcik

[57] ABSTRACT

An arrangement for attaching a cover member onto a casing of dielectric coaxial resonators and the like, which is capable of attaching the cover member onto the casing containing the resonators in it for fixing in a so-called single operation, while establishing a positive electrical conduction between outer conductors of the resonators and the casing.

6 Claims, 6 Drawing Figures

COVER ATTACHING ARRANGEMENT FOR CASING OF DIELECTRIC COAXIAL RESONATORS

BACKGROUND OF THE INVENTION

The present invention generally relates to a casing for an electrical or electronic device, and more particularly, to an arrangement for attaching a cover member onto a casing of dielectric coaxial resonators and the like to be employed for a microwave filter, etc.

Generally, a dielectric coaxial resonator, for example, a ¼ wavelength coaxial TEM resonator 1 as shown in FIG. 1 includes an inner conductor 2, an outer conductor 3 and a dielectric member 4 of a ceramic dielectric material of titanium oxide group, etc. More specifically, the cylindrical or pipe-like dielectric member 4 has a central bore **4*h* with an inner wall face 4*a*, and an outer wall face 4*b*, and a material superior in high frequency conductivity and close adhesion with respect to the dielectric member 4, e.g., silver paste is baked onto the inner wall face 4*a* and the outer wall face 4*b* so as to form the inner conductor 2 and the outer conductor 3. In a hollow interior of the inner conductor 2, a central rod 5 of a similar ceramic material and having an axial length longer than that of the dielectric member 4 is fitted and fixed depending on necessity, with one end 6 of the rod 5 which projects outwardly to a certain extent from an open end 7 of the resonator 1 being covered by an electrode film 8 extended from the inner conductor 2. The inner conductor 2 and the outer conductor 3 are short-circuited by another electrode layer 9 at the other end of the resonator 1**.

FIG. 2 shows only an essential portion of a conventional dielectric resonator 11 for another example which does not employ the central rod 5 as referred to above. In the resonator 11, the central rod 5 is replaced by a terminal electrode 12 of any proper shape fitted partly into the central bore **4*h* applied with the inner conductor 2, and fixed by a conductive bonding agent for connection with the inner conductor 2. To the upper portion of the terminal electrode 12 properly shaped and projecting outwardly to a predetermined extent from the open end of the resonator 11, electrodes 23 and 24 each at one side of capacitors 21 and 22 are connected, while the other electrodes 25 and 26 of said capacitors 21 and 22 are connected to corresponding ends of lead wires 27 and 28 whose other ends are further connected, for example, to other resonators, connectors, etc. (not shown). These capacitors 21 and 22 are of chip-type capacitors intended for capacity coupling of the resonator 11** with such external components.

In FIG. 3, there is shown an electrical filter 30 constructed through employment of the resonators as described above, particularly, the resonators 11 as shown in FIG. 2, with like parts in FIG. 2 being designated by like reference numerals.

The filter 30 in FIG. 3 includes a case 40 of a rectangular cubic box-like configuration made, for example, of duralumin or the like, and formed with recesses 51, 52, 53 and 54 of a semi-circular cross section arranged in a parallel relation at predetermined small intervals therebetween. The filter 30 is also formed with grooves 61, 62 and 63 each of a semi-circular cross section, extending between the recesses 51 and 52, 52 and 53, and 53 and 54, and further, formed with grooves 71 and 72 extending between the recess 51 and the outer side of the case 40, and between the recess 54 and the outer side of the case 40 respectively, with the grooves 71, 61, 62, 63 and 72 being aligned on a straight line. After mounting various parts on the case 40 as described hereinbelow, a cover member (not shown) having construction generally similar to that of the case 40 is applied onto said case 40 so as to be fixed by screws for completion of the product.

Into the recesses 51, 52, 53 and 54, the resonators 11A, 11B, 11C and 11D are fitted each by half, with the outer conductors 3 thereof being fixed to the case 40 for electrical conduction. Such fixing is effected, for example, through employment of a conductive bonding agent or by screws. An input coaxial connector 81 is partly fitted in the groove 71, while an output coaxial connector 82 is also partly fitted in the groove 72, and both of these connectors 81 and 82 are fixed to the case 40 and its cover member (not shown) by a conventional practice. A central terminal of the input coaxial connector 81 is connected to the capacitor 21 of the first stage resonator 11A through a lead wire 91. The capacitor 22 of the first stage resonator 11A is connected to the capacitor 21 of the second stage resonator 11B by a lead wire 92 through the groove 61. The capacitor 22 of the second stage resonator 11B is connected to the capacitor 21 of the third stage resonator 11C by a lead wire 93 through the groove 62. The capacitor 22 of the third stage resonator 11C is connected to the capacitor 21 of the fourth stage resonator 11D by a lead wire 94 through the groove 63. The capacitor 22 of the fourth stage resonator 11D is connected to a central terminal of the output coaxial connector 82 by a lead wire 95.

As is seen from the filter construction described so far as one example, the resonators 11 are bonded at the outer conductors 3 thereof to the case 40 and the cover member through employment of a conductive bonding agent, or metallic nets (not particularly shown) of copper and the like are disposed between the outer conductors 3 and the case 40 and cover member, with the metallic nets being soaked with a bonding agent for subsequent fixing of the cover member to the case 40 by screws, which requires an extremely troublesome procedure. Meanwhile, in other known structures, the fixing of the cover member by screws are replaced by bonding of the cover member to the case by a bonding agent or solder, but even in such arrangement, similar problems to those in the screw fixing are also experienced.

SUMMARY OF THE INVENTION

Accordingly, an essential object of the present invention is to provide an arrangement for attaching a cover member onto a casing of dielectric coaxial resonators and the like, which is capable of attaching a cover member onto a casing containing the resonators therein for fixing in a so-called single operation, while establishing a positive electrical conduction between outer conductors of the resonators and the casing.

Another important object of the present invention is to provide an arrangement for attaching a cover member onto a casing of the above described type, which is simple in construction and accurate in functioning, and can be readily manufactured at low cost.

In accomplishing these and other objects, according to one preferred embodiment of the present invention, there is provided a cover attaching arrangement for a casing of dielectric coaxial resonators, which includes a casing having side walls extending upwardly approximately at right angles with respect to its bottom wall so as to accommodate the dielectric coaxial resonators therein, a cover member having side walls extending downwardly approximately at right angles with respect to its top wall and adapted to be fitted over the casing, with the side walls of either one of the casing or the cover member being formed with engaging pieces, with the other thereof being formed with corresponding engaging openings so as to retain the casing unreleasable from the cover member upon fitting of the engaging pieces with the engaging openings, and a spring means provided between the dielectric coaxial resonators and the cover member or between the dielectric coaxial resonators and the casing so as to urge the cover member in a direction for engagement between the engaging pieces and the engaging openings. Simultaneously, the spring means functions to conduct the outer conductors of the resonators with the casing and the cover member.

By the above arrangement according to the present invention, since the engaging pieces and the engaging openings are adapted to be coupled with each other when the cover member is fitted onto the casing which accommodates the dielectric coaxial resonators therein, with the spring force by the spring means being applied in a direction for positive engagement therebetween, the cover member may be readily attached onto the casing through a single operation upon fitting of the cover member over said casing. Moreover, according to the embodiment of the present invention, the spring member contacts, under pressure, the outer conductor of the dielectric coaxial resonator for conduction of the outer conductor with the casing and cover member through said spring member, and therefore, the outer conductor may be positively conducted with the casing and cover member without employment of a conductive bonding agent and the like.

BRIEF DESCRIPTION OF THE DRAWINGS

These and other objects and features of the present will become apparent from the following description taken in conjunction with the preferred embodiment thereof with reference to the accompanying drawings, in which.

DETAILED DESCRIPTION OF THE INVENTION

Figure 1:
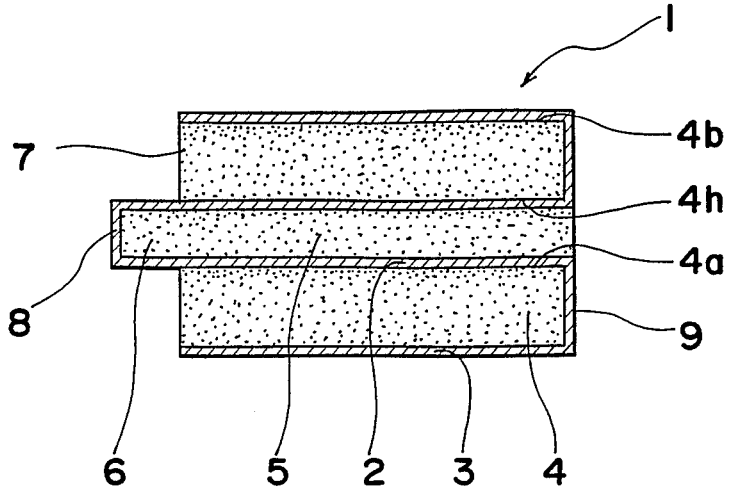
Fig. 1 PRIOR ART
FIG. 1 is a side sectional view of a conventional ¼ wavelength coaxial TEM resonator employing a cylindrical dielectric member.
Figure 2:
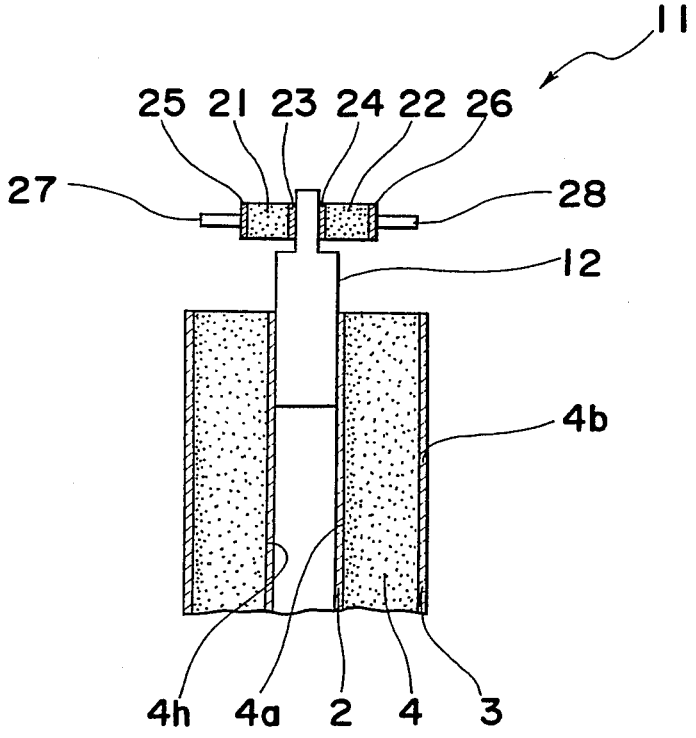
Fig. 2 PRIOR ART
FIG. 2 is a view similar to FIG. 1, which particularly shows another example of a conventional ¼ wavelength coaxial TEM resonator.
Figure 3:
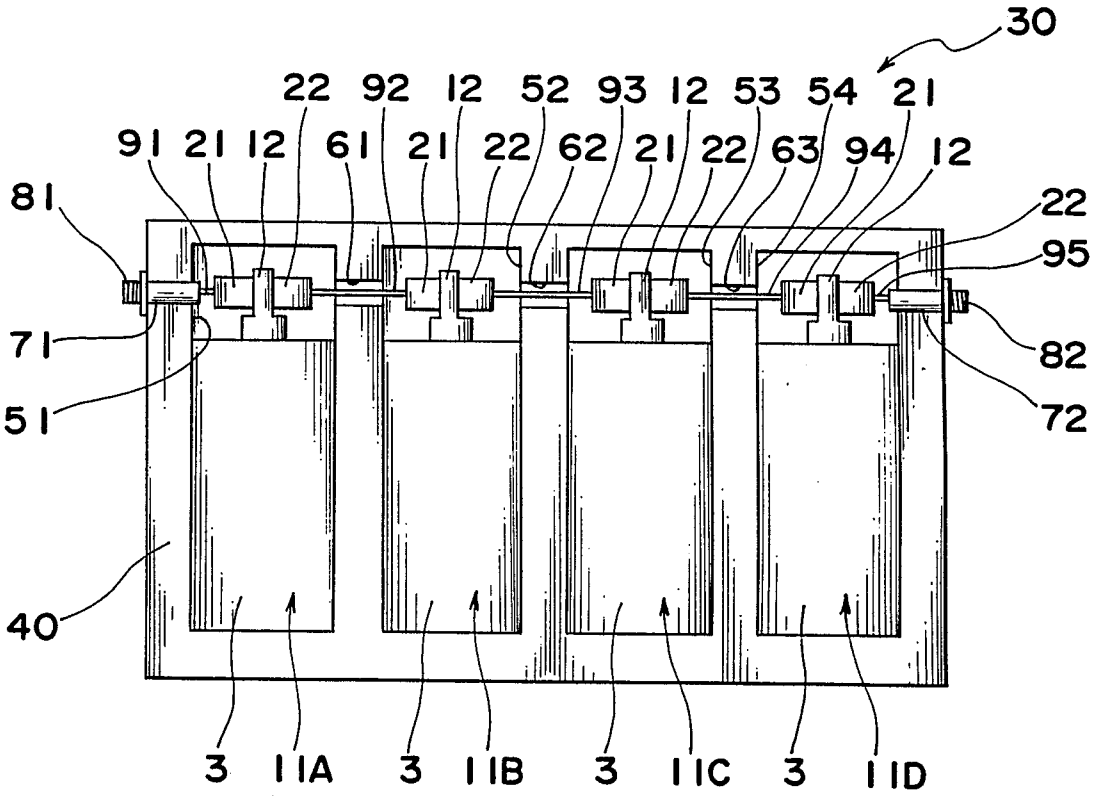
Fig. 3 PRIOR ART
FIG. 3 is a side elevational view of a conventional electrical filter employing the resonators as shown in FIG. 2.

Before the description of the present invention proceeds, it is to be noted that like parts are designated by like reference numerals throughout the accompanying drawings.

Figure 4:
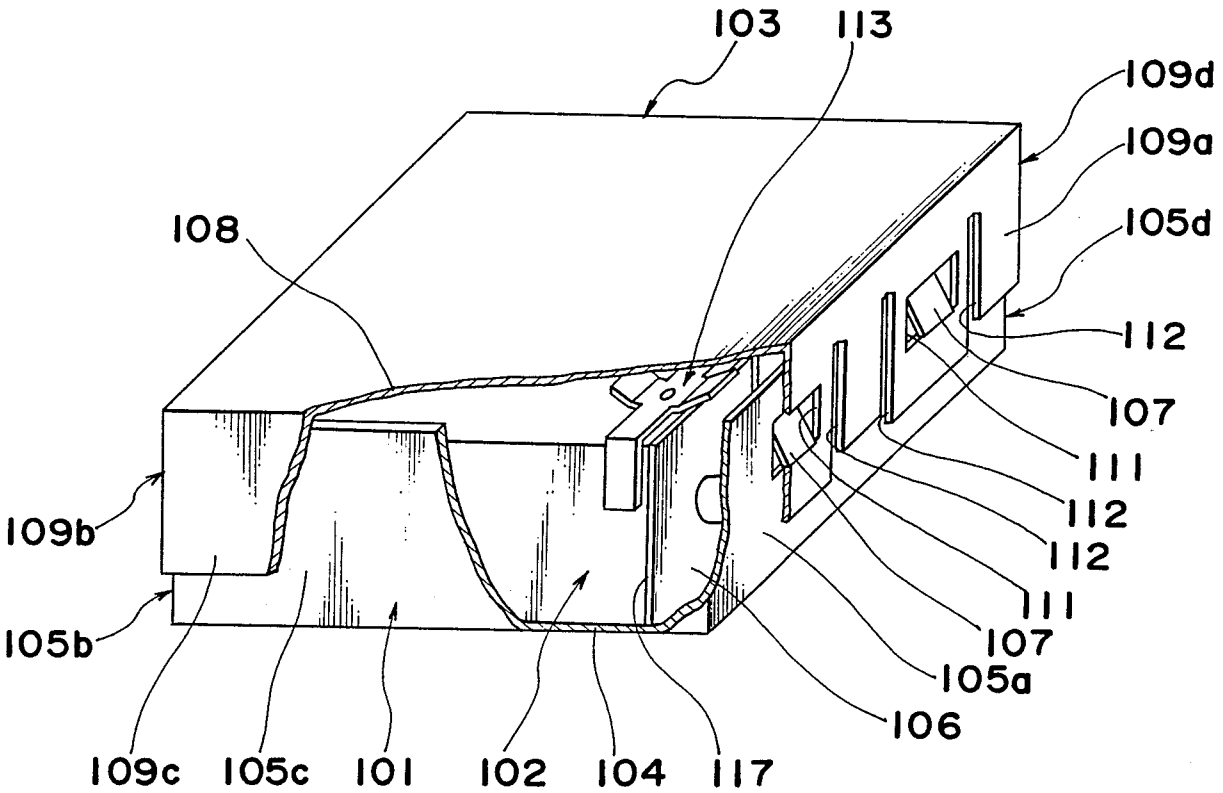
FIG. 4 is a perspective view, partly broken away, showing a cover attaching arrangement for a casing of dielectric coaxial resonators according to one preferred embodiment of the present invention.

Referring now to the drawings, there is shown in FIG. 4 a cover attaching arrangement for a casing of dielectric coaxial resonators according to one preferred embodiment of the present invention, which generally includes a casing 101 in which a plurality of ¼ wavelength coaxial TEM resonators 102 are accommodated to constitute a microwave filter, and a cover member 103 externally fitted over said casing 101. The casing 101 formed into a rectangular cubic box-like shape by a blanked metallic plate (not shown) such as a brass plate or the like, has side walls 105*a*, 105*b*, 105*c* and 105*d* which extend upwardly generally at right angles from respective side edges of a rectangular bottom wall 104. In the side wall 105*a* confronting the open faces 106 of the ¼ wavelength coaxial TEM resonators 102 contained in the casing 101 and each having a rectangular cross section, there are formed two engaging pieces 107 by cutting and raising part of the wall 105*a* slantwise downwardly. Similar engaging pieces 107 (not shown) are also formed in the side wall 105*b* of the casing 101 confronting the short-circuited faces of the resonators 102 at the side opposite to the open face side thereof.

On the other hand, the cover member 103 for the casing 101 is also formed into a rectangular cubic box-like configuration by blanking a metallic plate such as a brass plate or the like as in the casing 101 so as to be externally fitted over said casing 101, and includes side walls 109*a*, 109*b*, 109*c* and 109*d* extending downwardly generally at right angles from respective side edges of a top wall 108. In the side wall 109*a* of the cover member 103 confronting the side wall 105*a* of the casing 101 formed with the engaging pieces 107, there are formed two corresponding engaging holes 111 of a rectangular shape into which said engaging pieces 107 are fitted. Meanwhile, in the side wall 109*b* of the cover member 103 confronting the side wall 105*b* of the casing 101 formed with the engaging pieces 107, similar engaging holes 111 are formed for receiving said engaging pieces 107 of the side wall 105*b*.

Figure 5:
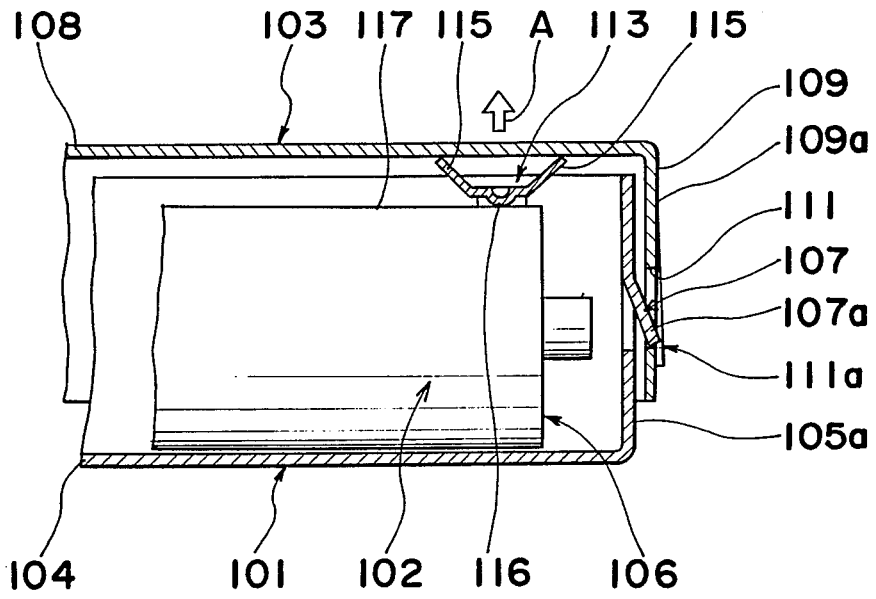
FIG. 5 is a side sectional view of the arrangement of FIG. 4.

As shown in FIG. 5, each of the engaging pieces 107 formed in the side walls 105*a* and 105*b* of the casing 101 is so arranged as to be fitted into each of the corresponding engaging holes 111 formed in the side walls 109*a* and 109*b* of the cover member 103, with the forward edge 107*a* of the engaging piece 107 contacting the corresponding inner edge 111*a* of the confronting engaging hole 111, when the cover member 103 has been fitted over the casing 101, and thus, the cover member 103 comes to be positively retained on the casing 101. Furthermore, as shown in FIG. 4, cut portions 112 are formed along opposite sides of each of the engaging holes 111 in the side walls 109*a* and 109*b* of the cover member 103 so as to cause the portion of the side wall formed with the hole 111 to be inclined inwardly toward the inner side of the cover member 103 for positive engagement of the forward edge 107*a* of the engaging piece 107 with the inner edge 111*a* of the hole 111.

Figure 6:
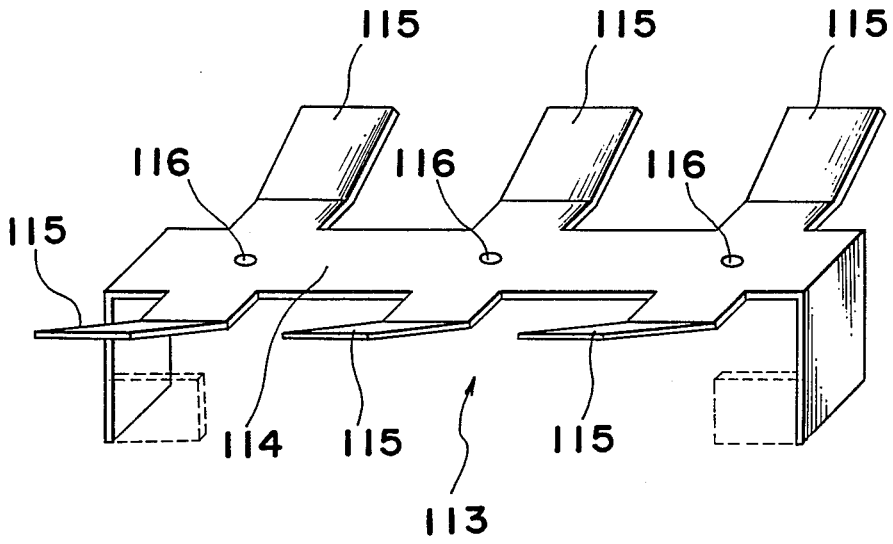
FIG. 6 is a perspective view showing on an enlarged scale, a spring member employed in the arrangement of FIG. 4.

Meanwhile, there is provided a spring member 113 between the ¼ wavelength coaxial TEM resonator 102 and the cover member 103. As illustrated in FIG. 6, the spring member 113 includes a common support portion 114 having a predetermined width and folded at opposite ends, and spring pieces 115 of any desired size formed to extend outwardly from the common support portion at predetermined intervals, with said common support portion 114 being further formed with hemispherical contact protrusions 116. As shown in FIG. 5, the above spring member 113 is disposed in an elastically deformed state between the ¼ wavelength coaxial TEM resonator 102 and the cover member 103 in a position closer to the open face of the resonator 102 depending on necessity, and the spring pieces 115 contacting under pressure the top wall 108 of the cover member 103, with the contact protrusions 116 being pressed against the outer conductor 117 of the resonator 102.

It should be noted here that the contact protrusions 116 may be replaced by holes (not particularly shown) formed by punching at the same positions as for the protrusions 116. If the punching is effected in a direction from the spring pieces 115 toward the outer conductor 117 of the resonator 102, the burr made by the punching functions as a contact point with respect to the outer conductor 117. Moreover, the outer conductor 117 visible through the punched holes and the spring member 113 may be soldered to each other through utilization of said punched holes. It may be further so modified as to form portions folded at right angles from the opposite ends of the spring member 113 as shown by dotted lines in FIG. 6 for applying such folded portion to the short-circuited face side of the resonator 102, thereby to effect positioning of the spring member 113 with respect to the resonator 102.

In the above construction, the cover member 103 is urged in the direction indicated by the arrow A in FIG. 5 in which the forward edges 107*a* of the engaging pieces 107 of the casing 101 engage the inner edges 111*a* of the engaging holes 111 of the cover member 103, and thus, the cover member 103 is fixed to the casing 101.

By the above arrangement, with the plurality of ¼ wavelength coaxial TEM resonators 102 being accommodated in the casing 101, and the spring member 113 placed thereon, when the cover member 103 is depressed onto the casing 101 against the spring force of the spring member 113 until the respective engaging pieces 107 are fitted into the corresponding engaging holes 111, the cover member 103 can be readily fixed onto the casing 101 through the so-called single operation, while the respective resonators 102 are fixed in the casing 101 by the spring member 113, with the outer conductors 117 of said resonators being electrically conducted to the cover member 103 and casing 101 through the spring member 113.

It is to be noted here that, the foregoing embodiment may be so modified as to dispose the spring member 103 between the resonator 102 and the bottom wall 104 of the casing 101, or to form the engaging holes 111 at the side of the casing 101, with the engaging pieces 107 being formed at the side of the cover member 103.

It should also be noted that, in the foregoing embodiment, although the present invention has been mainly described with reference to the ¼ wavelength dielectric coaxial TEM resonators, the concept of the present invention is not limited in its application to such ¼ wavelength dielectric coaxial TEM resonators alone, but may be readily applied also to ½ wavelength dielectric coaxial resonators.

Furthermore, the present invention is also applicable to the resonators in which two or more dielectric resonators are formed in one dielectric block as disclosed, for example, in Japanese Patent Laid-Open Application Tokkaisho No. 58-9401.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A cover attaching arrangement for a casing of dielectric coaxial resonators, which comprises a casing having side walls extending upwardly approximately at right angles with respect to its bottom wall so as to accommodate the dielectric coaxial resonators therein, a cover member having side walls extending downwardly approximately at right angles with respect to its top wall and adapted to be fitted over said casing, said side walls of either one of said casing or said cover member being formed with engaging pieces, with the other thereof being formed with corresponding engaging openings so as to retain said casing unreleasable from said cover member upon fitting of said engaging pieces with said engaging openings, and a spring means provided between the dielectric coaxial resonator and said cover member or between said dielectric coaxial resonator and said casing so as to urge said cover member in a direction for engagement between said engaging pieces and said engaging openings.

2. A cover attaching arrangement as claimed in claim 1, wherein said spring means is adapted to establish an electrical conduction of the outer conductors of said dielectric coaxial resonators with respect to said casing and said cover member.

3. A cover attaching arrangement as claimed in claim 1, wherein said spring means is a plate spring including a common support portion, a plurality of spring pieces formed to extend outwardly from opposite sides of said common support portion at predetermined intervals, and contact portions formed on said common support portion for positive contact between said dielectric coaxial resonator and said cover member or said casing.

4. A cover attaching arrangement as claimed in claim 3, wherein said contact portions are hemispherical contact projections.

5. A cover attaching arrangement as claimed in claim 3, wherein said contact portions are a plurality of small holes formed by punching in said common support portion.

6. A cover attaching arrangement as claimed in claim 3, wherein said common support portion is folded at opposite end portions thereof in such a manner as to achieve proper positioning of said plate spring with respect to the dielectric coaxial resonator within said casing.

* * * * *